US007757450B2

(12) United States Patent
Reyes et al.

(10) Patent No.: US 7,757,450 B2
(45) Date of Patent: Jul. 20, 2010

(54) CONTROL JOINT

(75) Inventors: Erenio Reyes, Miami, FL (US); Melvin J. Kurpinski, Fort Lauderdale, FL (US)

(73) Assignee: Dietrich Industries, Inc., Columbus, OH (US)

( * ) Notice: Subject to any disclaimer, the term of this patent is extended or adjusted under 35 U.S.C. 154(b) by 783 days.

(21) Appl. No.: 11/034,591

(22) Filed: Jan. 13, 2005

(65) Prior Publication Data

US 2006/0150553 A1 Jul. 13, 2006

(51) Int. Cl.
*E04B 1/68* (2006.01)
*E04B 1/684* (2006.01)

(52) U.S. Cl. ..... 52/396.05; 52/396.4; 52/396.06; 52/396.08; 404/68; 14/73.5

(58) Field of Classification Search ..... 52/393, 52/396.02, 396.03, 396.04, 396.05, 396.08, 52/468, 471, 288.1, 396.06, 396.07, 396.1, 52/396.09, 257, 256, 255, 716.2, 717.05, 52/717.03, 57; 404/68, 69, 49; 14/73.5, 14/14

See application file for complete search history.

(56) References Cited

U.S. PATENT DOCUMENTS

| | | | | |
|---|---|---|---|---|
| 1,029,106 | A | 6/1912 | Collins | |
| 1,204,955 | A | 11/1916 | Day | |
| 1,337,840 | A | 4/1920 | Hawley | |
| 1,389,057 | A | 8/1921 | Lavigue | |
| 1,624,121 | A | 4/1927 | Thiem | |
| 1,673,971 | A | 6/1928 | Dowell | |
| 1,954,847 | A | 4/1934 | Scholer et al. | |
| 2,114,048 | A | 4/1938 | Murray | |
| 2,142,305 | A | 1/1939 | Davis | |
| 2,272,162 | A | 2/1942 | Davis | |
| 2,298,251 | A * | 10/1942 | Burson | 52/27 |
| 2,642,632 | A | 6/1953 | Savage | |
| RE24,658 | E | 6/1959 | Hollister | |
| 2,922,385 | A | 1/1960 | Murray | |
| 3,114,219 | A * | 12/1963 | Bradley | 52/127.3 |
| 3,139,703 | A | 7/1964 | Hilt | |
| 3,192,577 | A | 7/1965 | Barr | |
| 3,255,561 | A * | 6/1966 | Cable | 52/255 |
| 3,331,176 | A | 7/1967 | Washam | |
| 3,358,402 | A | 12/1967 | Sahm | |

(Continued)

FOREIGN PATENT DOCUMENTS

JP 2002364087 A 12/2002

OTHER PUBLICATIONS

Stucco Drywall Insulated Exteriors Accessories, Vinyl Corp. 1988, pp. 1-10, Miami.

(Continued)

*Primary Examiner*—Phi Dieu Tran A
(74) *Attorney, Agent, or Firm*—Fay Sharpe LLP

(57) ABSTRACT

A flexible control joint for use in plastering and stucco applications. Various embodiments of the flexible control joint may be used to form screed walls for different thicknesses of plaster materials applied to adjoining walls or other structures. The walls or other structures may be of similar or dissimilar constructions. Various embodiments of the control joint may be used to form corner arrangements or T-arrangements to achieve desired design effects.

8 Claims, 9 Drawing Sheets

U.S. PATENT DOCUMENTS 3,398,494 A * 8/1968 Larson ..... 52/371
3,411,260 A * 11/1968 Dill ..... 52/396.03
3,440,934 A * 4/1969 Dill ..... 404/74
3,568,391 A * 3/1971 Conway ..... 52/586.2
3,667,174 A 6/1972 Arnett
3,951,562 A * 4/1976 Fyfe ..... 404/68
3,956,557 A * 5/1976 Hurst ..... 428/167
4,302,262 A 11/1981 Kay
4,353,192 A 10/1982 Pearson et al.
4,364,212 A 12/1982 Pearson et al.
4,374,442 A * 2/1983 Hein et al. ..... 14/73.1
4,391,074 A 7/1983 Holsman
4,447,172 A * 5/1984 Galbreath ..... 404/68
4,485,600 A 12/1984 Olson
4,651,488 A * 3/1987 Nicholas et al. ..... 52/396.02
4,785,601 A 11/1988 Tupman
4,932,183 A * 6/1990 Coulston ..... 52/417
4,967,519 A 11/1990 Sieber
5,067,297 A * 11/1991 Sobol ..... 52/396.05
5,079,880 A 1/1992 Reid
5,081,814 A 1/1992 Singletary et al.
5,248,225 A 9/1993 Rose
5,313,755 A * 5/1994 Koenig, Jr. ..... 52/255
5,338,130 A * 8/1994 Baerveldt ..... 404/33
5,349,797 A * 9/1994 Stultz ..... 52/396.05
5,365,713 A * 11/1994 Nicholas et al. ..... 52/573.1
5,375,386 A * 12/1994 Goad ..... 52/396.03
5,423,154 A 6/1995 Maylon et al.
5,477,643 A * 12/1995 Koenig, Jr. ..... 52/100
5,584,152 A * 12/1996 Baerveldt ..... 52/396.05
5,625,986 A * 5/1997 Mansfield et al. ..... 52/255
5,628,857 A * 5/1997 Baerveldt ..... 156/244.25
5,630,297 A 5/1997 Rutherford
5,791,111 A * 8/1998 Beenders ..... 52/396.05
5,799,456 A * 9/1998 Shreiner et al. ..... 52/396.04
5,802,785 A 9/1998 Crook
5,887,400 A * 3/1999 Bratek et al. ..... 52/396.03
5,916,095 A 6/1999 Tamlyn
5,937,600 A 8/1999 Larson
5,946,870 A 9/1999 Bifano et al.
5,970,671 A 10/1999 Bifano et al.
5,979,123 A 11/1999 Brockman
6,119,416 A 9/2000 Larson
6,119,429 A 9/2000 Bifano et al.
6,134,847 A 10/2000 Bifano et al.
6,161,344 A 12/2000 Blanchett
6,170,207 B1 1/2001 Saindon
6,293,064 B1 9/2001 Larson
6,298,609 B1 10/2001 Bifano et al.
6,305,130 B1 10/2001 Ackerman, Jr.
6,385,932 B1 5/2002 Melchiori
6,470,638 B1 10/2002 Larson
6,591,559 B2 7/2003 Contreras et al.
6,609,341 B2 8/2003 Maylon et al.
6,622,432 B2 9/2003 Zacher et al.
6,640,508 B2 11/2003 Lindgren et al.
6,663,159 B2 * 12/2003 Kinkaide ..... 296/100.01
6,698,144 B1 3/2004 Larson
6,751,919 B2 * 6/2004 Calixto ..... 52/573.1
6,776,423 B1 8/2004 Guht
6,948,287 B2 * 9/2005 Korn ..... 52/393
6,948,716 B2 * 9/2005 Drouin ..... 277/606
7,240,905 B1 * 7/2007 Stahl, Sr. ..... 277/652
7,284,357 B2 * 10/2007 McInerney et al. ..... 52/741.41
2003/0177725 A1 9/2003 Gatherum
2005/0257461 A1 11/2005 Daly, IV
2006/0254169 A1 11/2006 McFadden
2007/0062137 A1 3/2007 Maylon
2007/0130861 A1 6/2007 Chenier et al.
2007/0169428 A1 7/2007 Amster et al.
2007/0180791 A1 8/2007 Amster et al.
2008/0016808 A1 1/2008 Pilz

OTHER PUBLICATIONS

Stucco Drywall Insulated Exteriors Accessories, Vinyl Corp. 1989, pp. 1-11, Miami, FL.
Stucco Plaster Veneer Drywall Insulated Wall & Ceiling Accessories, Vinyl Corp. 1990, pp. 1-15, Miami.
Product Catalog, Vinyl Corp., 2004, Miami, FL.

* cited by examiner

CONTROL JOINT

BACKGROUND OF THE INVENTION

1. Field of the Invention

The invention relates to building construction components and, more particularly, to a flexible control joint for walls of dissimilar construction which facilitates the application of different thicknesses of plaster or similar material to the walls.

2. Description of the Invention Background

Plaster, cement and stucco-type building materials have been employed in the construction of walls for residential and commercial buildings for many years to achieve a variety of different designs and wall textures. Various methods and application techniques exist for applying such materials to walls and other structures. One such method that is commonly employed involves attaching lath material to a wall frame constructed from wood or metal studs. The lath material serves to stabilize the plaster while it is in its flowable state prior to drying. Similar approaches are also commonly employed when the underlying structure is fabricated from, for example, concrete or concrete blocks. The lath material is applied to the wall surface (exterior or interior—what ever the case may be) and then the plaster material is applied to the lath. In other applications, however, the plaster is applied directly to sheathing or wallboard material.

In multistory applications wherein the wall structures of one story differ in construction from the walls structures of an adjacent story, the walls of one structure may move relative to the walls of the adjacent structure at different rates due to differences in the thermal expansion and contraction characteristics of the underlying materials. Plaster material is often applied to such wall structures and control joint members are applied along the edges of the wall structures to form screed walls for the plaster which protect the otherwise exposed ends of the plaster. Flexible control joints have been developed to span between the dissimilar wall structures and serve to form screed walls of identical heights which accommodate amounts of plaster materials that have the same thicknesses on each wall structure.

In many applications, however, it is desirable to apply the plaster material in different thicknesses to distinguish between the stories and create desired aesthetic appearances and effects. For example, it may be desirable to apply a coat of plaster material to the lower story wall and a thicker coat of plaster to the upper story wall. Prior control joint arrangements, however, cannot accommodate different thicknesses of plaster on opposing sides of the joint.

Thus, there is a need for a flexible control joint that will form screed edges to accommodate adjoining plaster materials that may have different thicknesses and that is flexible to accommodate movement (due to expansion and contraction) of the of the adjoining wall structures which may be of dissimilar construction.

SUMMARY

In accordance with one embodiment of the present invention, there is provided a flexible control joint that has a first base portion and a first screed wall that has a first proximal end that protrudes from the first base portion and a first distal end that is remote from the first base portion. The control joint of this embodiment further has a second base portion and a second screed wall that has a second proximal end that protrudes from the second base portion and a second distal end that is remote from the second base portion. A flexible attachment assembly is attached between the first screed wall and the second screed wall such that the first and second screed walls are in spaced relationship to each other. The flexible attachment assembly facilitates flexible movement between the first and second screed walls.

Another embodiment of the present invention comprises a flexible control joint that includes a first base portion and a first screed wall that has a first proximal end that protrudes from the first base portion and a first distal end that is remote from the first base portion. The control joint further has a second base portion and a second screed wall that has a second proximal end that protrudes from the second base portion and a second distal end that is remote from the second base portion. A first intermediate web is attached to the first distal end of the first screed wall. The first intermediate web has a first intermediate web end intermediate the first proximal end of the first screed wall and the second proximal end of the second screed wall. The first intermediate web end is spaced from the first proximal end and the second proximal end. A second intermediate web is attached to the first intermediate web end and the second distal end of the second screed wall and extends therebetween to facilitate flexible movement between the first and second screed walls. A first plaster-retainer protrudes from the first screed wall and a second plaster-retainer protrudes from the second screed wall.

Another embodiment of the present invention comprises a method for constructing walls for a multistory building. One version of the method includes constructing a first wall that has a first exterior surface and constructing a second wall above the first wall such that a joint is formed therebetween and such that the second wall has a second exterior surface. The method further includes attaching a flexible control joint to the first exterior surface and the second exterior surface such that the flexible control joint spans the joint therebetween and permits movement between the first wall and the second wall. The flexible control joint defines a first plaster level remote from the first exterior surface and a second plaster level remote from the second exterior surface. The method also includes applying first plaster material to the first exterior surface such that the first plaster material has a first thickness that corresponds to the first plaster level and applying second plaster material to the second exterior surface such that the second plaster material has a second thickness that corresponds to the second plaster level.

Another embodiment of the present invention comprises a building method that includes constructing a first wall portion that has a first exterior surface and constructing a second wall portion adjacent to the first wall portion such that a wall joint is formed therebetween and wherein the second wall portion has a second exterior surface. The method also includes attaching a flexible control joint to the first exterior surface and the second exterior surface such that the flexible control joint spans the wall joint therebetween and permits movement between the first wall portion and the second wall portion. The flexible control joint defines a first plaster level remote from the first exterior surface and a second plaster level remote from the second exterior surface. A first plaster material is applied to the first exterior surface such that the first plaster material has a first thickness that corresponds to the first plaster level and a second plaster material is applied to the second exterior surface such that the second plaster material has a second thickness that corresponds to the second plaster level.

Another embodiment of the present invention comprises a corner assembly for forming intersecting screed walls for adjacent amounts of plaster. In one embodiment, the corner assembly comprises a first control joint that has a first base portion and a first screed wall that has a first proximal end that protrudes from the first base portion and a first distal end that is remote from the first base portion. The first control joint further has a second base portion and a second screed wall that has a second proximal end that protrudes from the second base portion and a second distal end that is remote from the second base portion. A flexible attachment assembly is attached between the first screed wall and the second screed wall such that the first and second screed walls are in spaced relationship to each other. The flexible attachment assembly facilitates flexible movement between the first and second screed walls. The corner assembly further includes a second control joint that has another first base portion and another first screed wall that has another first proximal end that protrudes from the another first base portion and another first distal end that is remote from the another first base portion. The second control joint further includes another second base portion that has another second screed wall that has another second proximal end that protrudes from the another second base portion and another second distal end that is remote from the another second base portion. Another flexible attachment assembly is attached between the another first screed wall and the another second screed wall such that the another first screed wall and the another second screed wall are in spaced relationship to each other. The another flexible attachment assembly facilitates flexible movement between the another first screed wall and the another second screed wall and wherein an end of the first base portion abuts an end of the another first base portion and wherein an end of the second base portion abuts an end of the another second base portion.

Another embodiment of the subject invention comprises a T-arrangement for forming screed walls for adjacent amounts of plaster that includes at least three control joints. Each control joint has a first base portion and a first screed wall that has a first proximal end that protrudes from the first base portion. The first screed wall has a first distal end that is located a first distance away from the first base portion. Each control joint further has a second base portion and a second screed wall that has a second proximal end that protrudes from the second base portion. The second screed wall has a second distal end that is located a second distance away from the second base portion. The second distance is different from the first distance. A flexible attachment assembly is attached between the first screed wall and the second screed wall such that the first and second screed walls are in spaced relationship to each other. The flexible attachment assembly facilitates flexible movement between the first and second screed walls. The T-arrangement further includes an attachment medium that attaches the control joints together to form the T-arrangement.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE INVENTION

Figure 1:
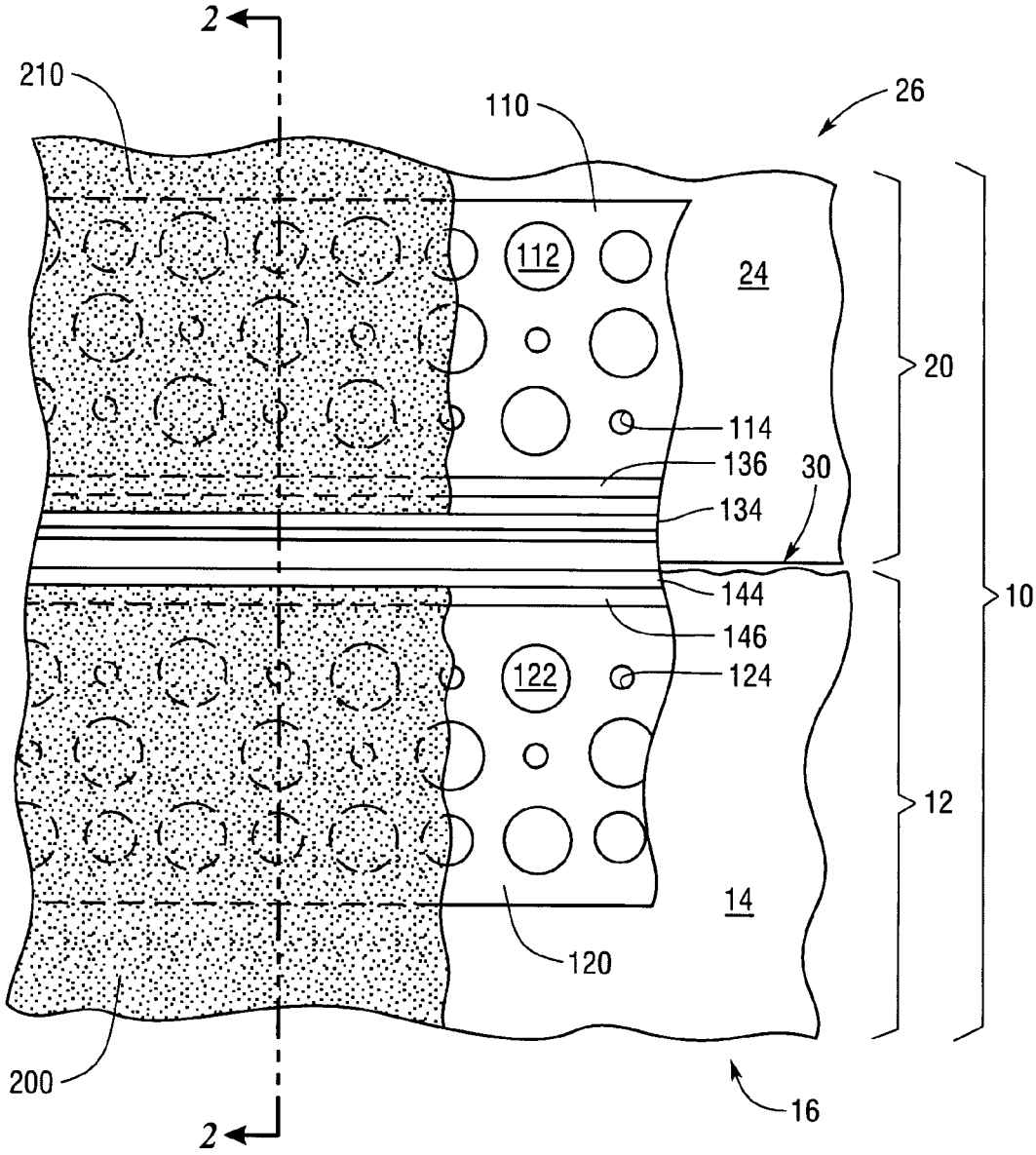
FIG. 1 is a plan view of two portions of adjacent wall structures having an embodiment of the control joint of the present invention therebetween.

Referring now to the drawings for the purposes of illustrating the present embodiments of the invention only and not for the purposes of limiting the same, FIG. 1 illustrates one embodiment of the control joint 100 of the present invention used in connection with a multistory building 10. As will become further evident as the Detailed Description proceeds, various embodiments of the control joint of the present invention may be effectively used in connection with multistory structures that have walls constructed from dissimilar materials which would likely have differing expansion and contraction characteristics.

For example, as shown in FIG. 1, the first story 12 is fabricated from concrete block or solid concrete 14 to establish a first wall 16 that has a first exterior wall surface 18. The second or upper story 20 located on and attached to the first wall 16 may, for example, be constructed from wood or metal framing components 22. Wall board material 24 such as that material sold under the trademark CELOTEX or other sheet materials may be attached thereto to form a second wall 26 that has a second exterior wall surface 28. The second exterior wall surface 28 may be substantially coplanar with the first exterior wall surface 18. A space or joint 30 is formed between the first story wall 16 and the second story wall 26. The control joint 100 of the present invention is sized to span the joint 30 as shown in FIG. 1.

Figure 2:
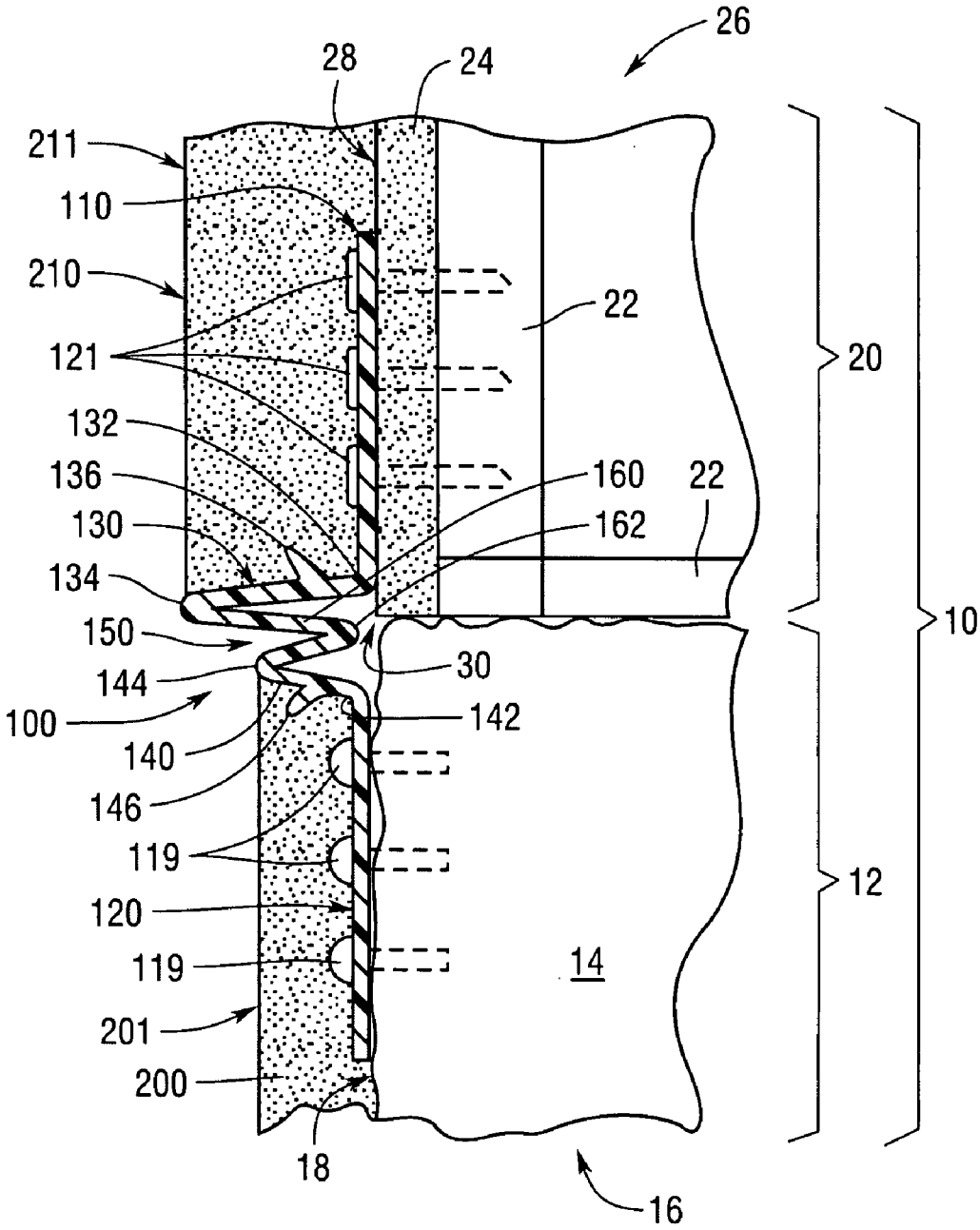
FIG. 2 is a partial cross-sectional view of the adjacent walls and control joint depicted in FIG. 1 taken along line II-II in FIG. 1.
Figure 4:
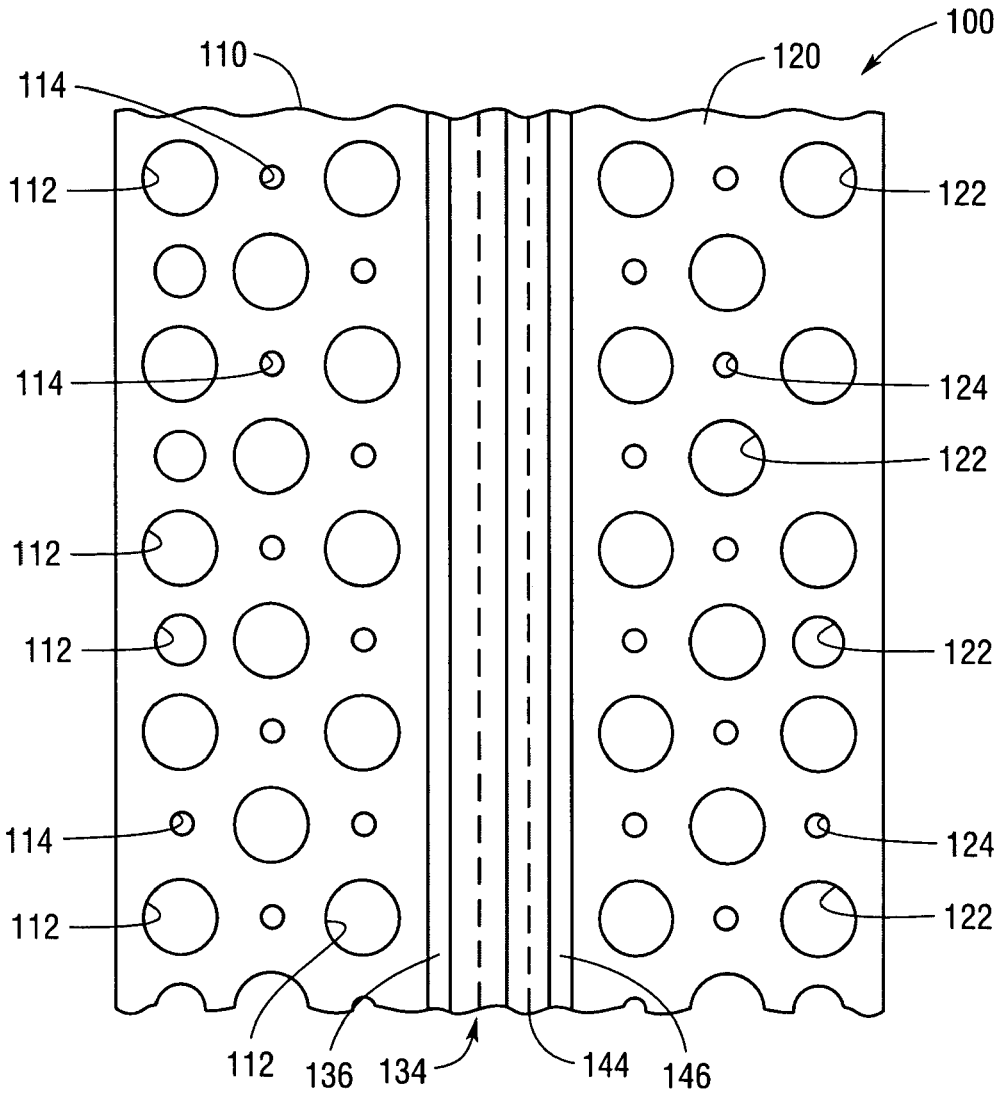
FIG. 4 is a partial top view of the control joint of FIG. 2.
Figure 3:
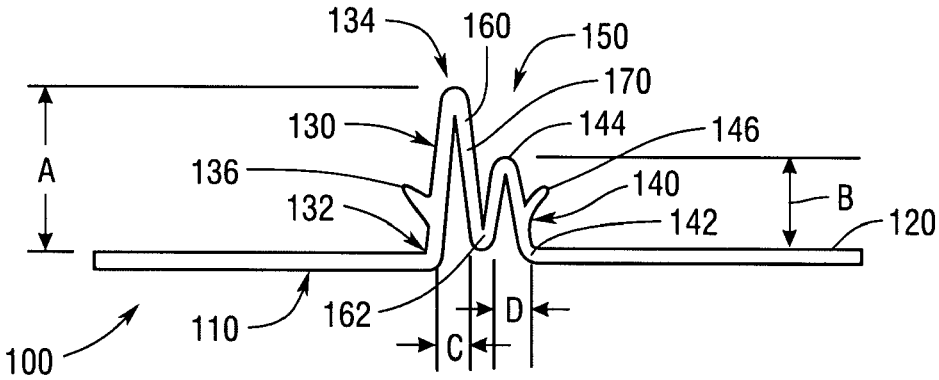
FIG. 3 is an end view of one embodiment of a control joint of the present invention.

More particularly and with reference to FIGS. 2 and 3, one embodiment of the control joint 100 includes a first base portion 110 and a second base portion 120. A first screed wall 130 protrudes from the first base portion 110 and a second screed wall 140 protrudes from the second base portion 120. A flexible attachment assembly generally designated as 150 extends between the first screed wall 130 and the second screed wall 140 to facilitate movement between the first screed wall 130 and the second screed wall 140.

As can be seen in FIG. 2, the first screed wall 130 has a first proximal end 132 that is attached to or protrudes from the first base portion 110. The first screed wall 130 further has a first distal end 134 that is located remote from the first base portion 110. For example, the first distal end 134 may be located a distance "A" from the first base portion 110 wherein distance "A" corresponds to a desired thickness of second plaster material 210 to be applied to the second exterior surface 28 of the second story wall 26 as will be discussed in further detail below. In one embodiment, for example, distance "A" may be approximately ⅞ of an inch.

The second screed wall 140 has a second proximal end 142 that is attached to or protrudes from the second base portion 120. The second screed wall 140 further has a second distal end 144 located a distance "B" from the second base portion 120 wherein distance "B" corresponds to a desired thickness of first plaster material 200 to be applied to the first exterior wall surface 18 of the first wall 16 as will be discussed in further detail below. In one embodiment, for example, distance "B" may be approximately ½ of an inch. In other embodiments, the control joint 100 could be fabricated such that distance "B" is greater than distance "A".

In one embodiment, the flexible attachment assembly 150 may have an accordion-like shape and include a first intermediate web 160 and a second intermediate web 170. The first intermediate web 160 is attached to or protrudes from the first distal end 134 of the first screed wall 130 and extends toward the first proximal end 132 of the first screed wall 130 to terminate in a first intermediate web end 162. The first intermediate web end 162 is spaced from the first proximal end 132 of the first screed wall 130 a distance "C" and from the second proximal end 142 of the second screed wall 140 a distance "D". In one embodiment, for example, distance C could be approximately ¼ inch and distance "D" could be approximately ¼ inch. Other distances could also be employed which are sufficient to enable the first and second screed walls 130, 140 to move relative to each other.

As can be seen in FIG. 2, the second intermediate web 170 extends between the first intermediate web end 162 and the second distal end 144 of the second screed wall 140 to complete the flexible attachment assembly 150. In one embodiment, the control joint 100 of the present invention is fabricated from vinyl material utilizing conventional extrusion techniques and equipment. For example, Exterior Grade polyvinylchloride (PVC) having the following grade numbers is particularly well-suited for exterior applications: ASTM-D-4216, ASTM-C-1063, and ASTM-D-1784. However, other control joint embodiments could be fabricated from other polymer materials having the desired ultraviolet light resistance, etc. or metal materials or the like could be employed without departing from the spirit and scope of the present invention.

To facilitate retention of the second plaster material 210, at least one and preferably a series of holes 112 are provided through the first base portion 110. Holes 112 may be round as shown and may be provided in various sizes. See FIG. 3. In the alternative, holes 112 may be provided in other shapes, sizes and arrangements without departing from the spirit and scope of the present invention. In addition, a series of fastener holes 114 are provided through the first base portion 110 to receive fasteners therethrough for fastening the first base portion 110 to the first wall 16 as will be discussed in further detail below.

Likewise, to facilitate retention of the first plaster material 200, at least one and preferably a series of holes 122 are provided through the second base portion 120. Holes 122 may be round as shown and may be provided in various sizes. In the alternative, holes 122 may be provided in other shapes, sizes and arrangements without departing from the spirit and scope of the present invention. In addition, a series of fastener holes 124 are provided through the second base portion 120 to receive fasteners therethrough for fastening the second base portion 120 to the second wall 26 as will be discussed in further detail below.

Also in one embodiment, to facilitate retention of the first plaster 200 in position and in at least partial contact with the first screed wall, the first screed wall 130 may be formed with a first plaster retainer 136. In one embodiment, the first plaster retainer 136 is formed at an acute angle with the first screed wall 130. However, the first plaster retainer 136 could be formed at various angles with respect to the first screed portion without departing from the spirit and scope of the present invention.

Likewise, to facilitate retention of the second plaster material in position and at least in partial contact with the second screed wall 140, the second screed wall is formed with a second plaster retainer 146. In one embodiment, the second plaster retainer 146 is formed at an acute angle with the second screed wall 140. However, the second plaster retainer 146 could be formed at various angles with respect to the second screed portion without departing from the spirit and scope of the present invention.

The control joint 100 may be used as follows. After the first wall 16 and the second wall 26 have been constructed such that a space or joint 30 is formed therebetween, the control joint 100 is oriented such that it spans the joint 30 and the first base portion 110 is in confronting relationship with the outer surface 18 of the first wall 16. Suitable fasteners 119 are inserted through at least some of the fastener holes 114 in the first base portion 110 to attach the first base portion to the first wall 16. Fasteners 119 may comprise conventional fasteners that are suited for the types of materials from which the first wall is fabricated. For example, fasteners 119 may comprise concrete fasteners, screws, nails, etc. In FIG. 1, for example, fasteners 119 comprise conventional concrete fasteners.

The second base portion 120 is also oriented in confronting relationship with the outer surface 28 of the second wall 26. Suitable fasteners 121 are inserted through at least some of the fastener holes 124 in the second base portion 120 to attaché the second base portion 120 to the second wall 26. Fasteners 121 may comprise conventional fasteners that are suited for the types of materials from which the first wall is fabricated. For example, fasteners 121 may comprise concrete fasteners, screws, nails, etc. In FIG. 1, for example, fasteners 119 comprise conventional nails.

After the control joint 100 has been attached in the above-described manner, the first amount of plaster 200 is applied to the exterior surface 18 of the first wall 16 so that the outer surface 201 of the first plaster 200 stops at or is substantially even with the second distal end 144 of the second screed wall 140 as shown in FIG. 1. The installer may find it convenient to place a portion of a screed tool or other type of leveling tool on the second distal end 144 to screed off the excess plaster so that the first amount of plaster has a substantially uniform thickness. Thus, the thickness of the first amount of plaster 200 is substantially equivalent to distance "B" in this embodiment. As can further be seen in FIG. 1, the plaster 200 covers the second base portion 210 and the heads of fasteners 120. The second plaster retainer 146 serves to assist in the retention of the first plaster 200 in abutting relationship with respect to the second screed wall 140 as shown in FIG. 1.

Likewise, a second amount of plaster 210 is applied to the outer surface 28 of the second wall 26 so that the outer surface 211 of the second amount of plaster 210 stops at or is substantially even with the first distal end 134 of the first screed wall 130 as shown in FIG. 1. Again, the installer may find it convenient to place a portion of the screed tool or other leveling tool on the first distal end to screed off or remove the excess plaster so that the second amount of plaster has a substantially uniform thickness. Thus, the thickness of the second amount of plaster 210 is substantially equivalent to distance "A" in this embodiment. The second plaster 210 covers the first base portion 110 and the heads of fasteners 121. The first plaster retainer 136 serves to assist in the retention of the second plaster 210 in abutting relationship with the first screed wall 130 as shown in FIG. 1.

As used herein, the term "plaster" encompasses not only commercially available wall plaster materials, cement and stucco materials, but also essentially any materials that are flowable in an uncured state and which solidify in a cured state. Also, the terms "first story" and "second story" and "first wall" and "second wall" have been used herein in an exemplary manner to described one use of various embodiments of the subject invention. Such terms should in no way be deemed as limiting use of various embodiments to use solely between first and second story walls. Various embodiments of the present invention could be effectively used between a varieties of adjoining walls regardless of which stories the adjacent walls are located on.

Figure 5:
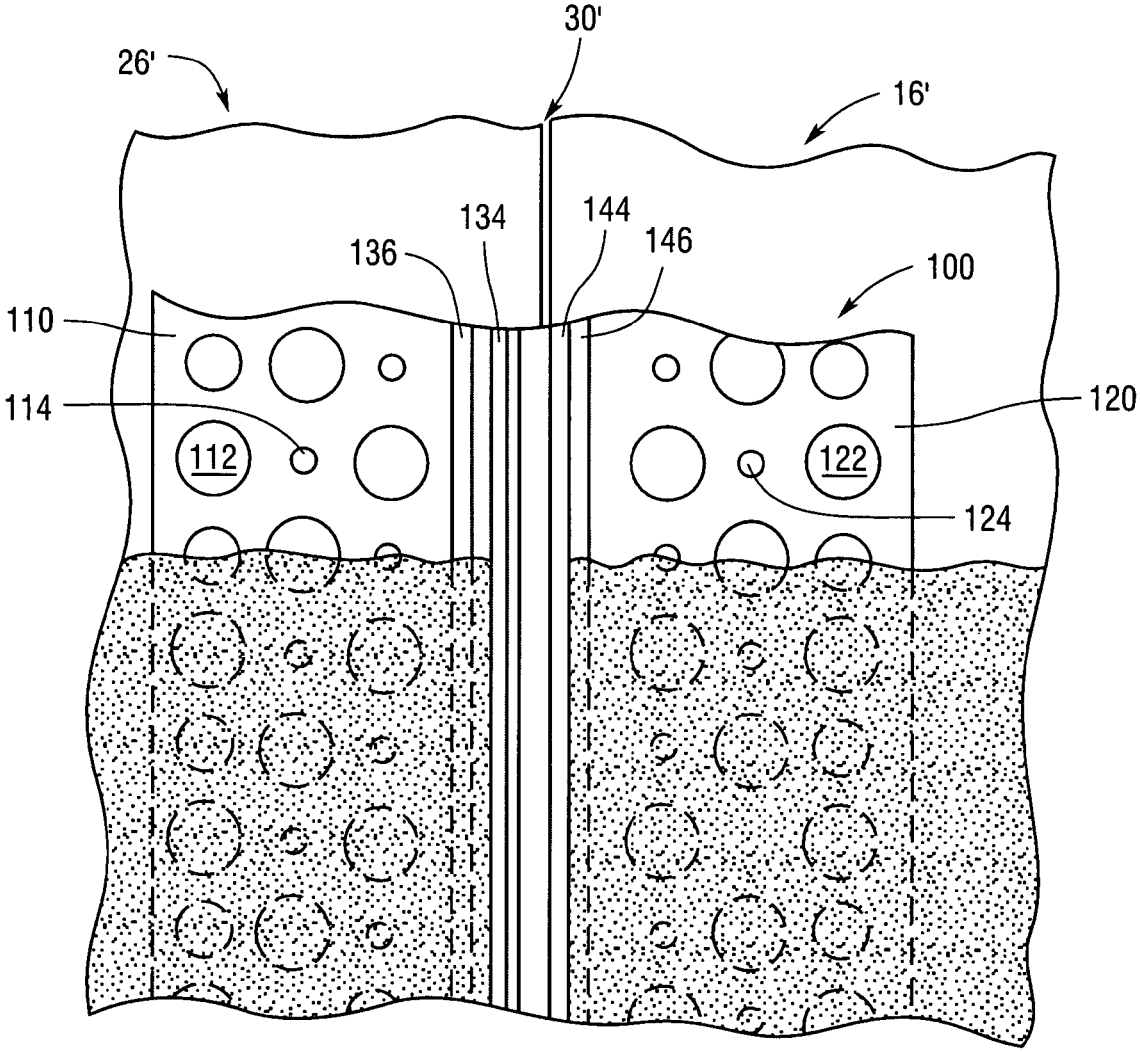
FIG. 5 is a plan view of another wall arrangement including two portions of adjacent wall structures and an embodiment of the control joint of the present invention therebetween.

Moreover, various embodiments of the present invention have been described herein as being used between adjoining walls wherein the joint formed between the walls essentially extends horizontally between the walls. However, the spatial orientation (i.e., horizontal, vertical, or angled orientation) of the joint formed between adjacent walls is not important to the effective operation of various embodiments of the present invention. For example, as illustrated in FIG. 5, various embodiments of the control joint 100 present invention could, for example, be effectively employed at the vertically extending joint 30' formed between two vertically extending walls 26', 16' which may be of similar or dissimilar construction in the manners described above.

Likewise, various embodiments of the control joint of the present invention could be used in connection with surfaces that are oriented on an angle to form a flexible joint therebetween and to provide screed walls for adjacent amounts of plaster applied to the surfaces without departing from the spirit and scope of the present invention. Various embodiments of the present invention may also be used to form screed edges for plaster arrangements that are employed to create desired aesthetic effects such as the method of use illustrated in FIGS. 6 and 7.

Figure 6:
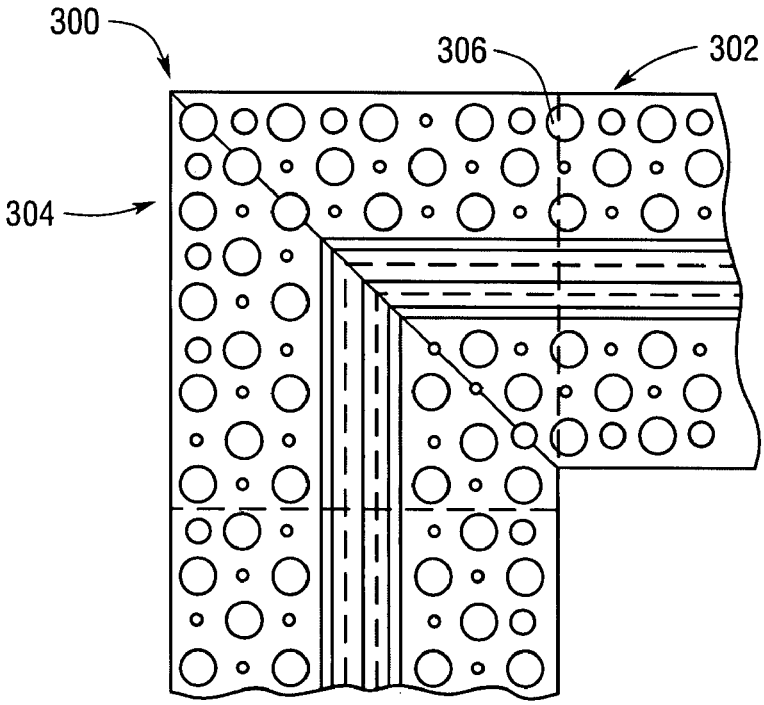
FIG. 6 is a partial plan view of two control joint embodiments of the present invention abutted together to form a corner assembly embodiment of the present invention.
Figure 7:
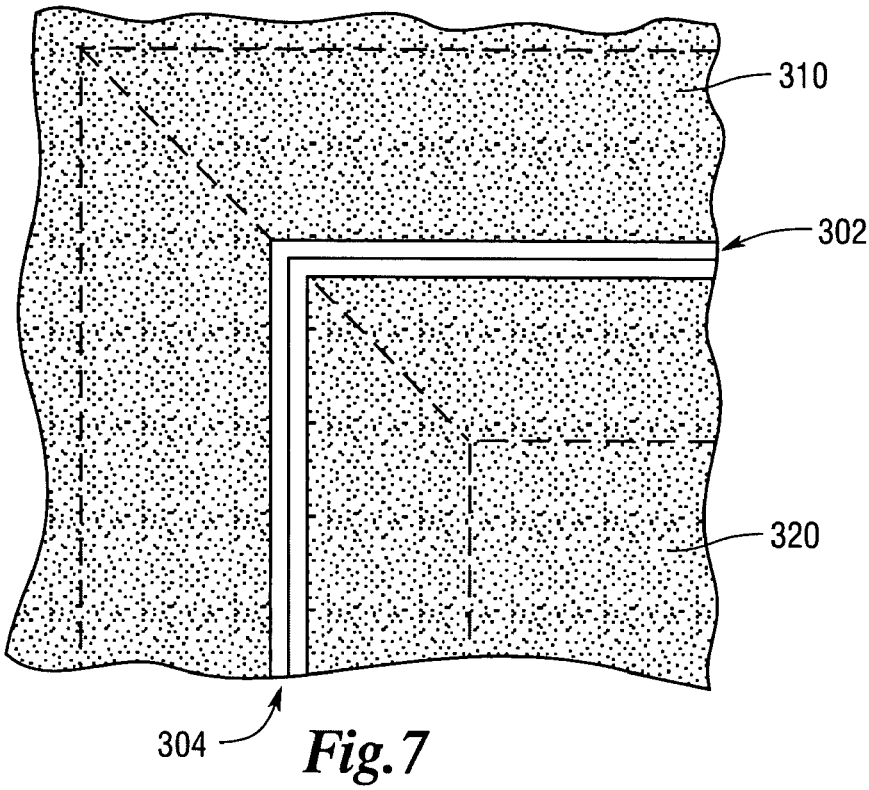
FIG. 7 is another partial plan view of the corner assembly of FIG. 6 with two amounts of plaster material applied thereto.

As can be seen in FIG. 6, pieces 302, 304 of control joint 100 may be mitered to form a corner arrangement 300. The pieces 302, 304 of control joint 100 may be held together for installation purposes by, for example, commercially available tape 306 or other appropriate types of adhesive mediums. The pieces 302, 304 may be attached to underlying structures (i.e., wallboard, concrete, brick, etc.) by appropriate fasteners in the manner described above. After the pieces 302, 304 (and other pieces of control joint 100 needed to complete the desired design) have been attached to the underlying structure, the plaster materials 310, 320 may be applied thereto as shown in FIG. 7. The thicknesses of the applied plaster materials 310, 320 may be governed by the heights of the first and second screed walls (distances "A" and "B" as described above). As in the other embodiments, the distances "A" and "B" are unequal.

Figure 10:
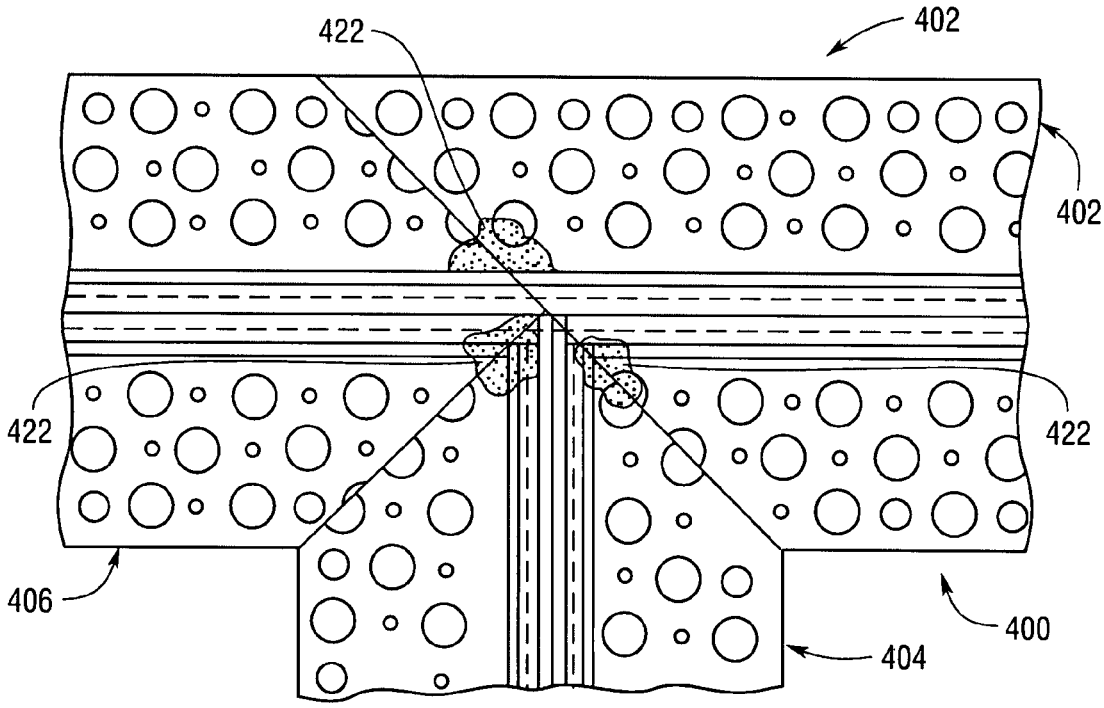
FIG. 10 is a partial top view of the "T"-arrangement depicted in FIGS. 8 and 9 prior to the application of the plaster material.
Figure 11:
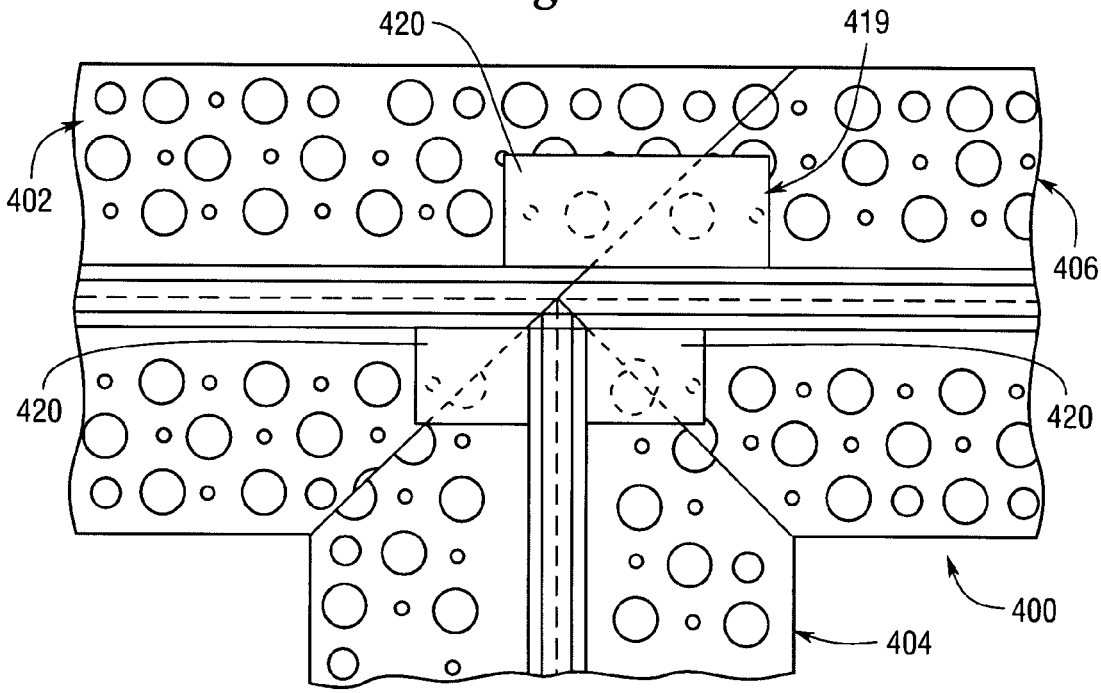
FIG. 11 is a bottom view of the "T"-arrangement of FIG. 10.

Yet another embodiment of the present invention is depicted in FIGS. 8-16. More particularly and with reference to FIGS. 8 and 9, pieces 402, 404 and 406 of control joint 100 may be mitered to form a "T" arrangement 400 that forms screed walls for supporting a first amount of plaster 410 that has a first thickness and a second amount of plaster 412 that has a second thickness and a third amount of plaster 414 that has a third thickness that is equal to the second thickness as will be discussed in further detail below. The pieces 402, 404, 406 of "T" arrangement 400 may be held together for installation purposes by an attachment medium 419. In one embodiment, the attachment medium 419 comprises pieces of commercially available tape 420 as shown in FIG. 11. In addition or in the alternative, the attachment medium 419 may comprise a commercially available adhesive medium or sealant such as silicone caulking 422 or the like that is applied to the joints wherein the pieces 402, 404, 406 come together as shown in FIG. 10. To further support the pieces 402, 404, 406 in the interconnected orientation shown in FIGS. 8-11, a coupling piece 500 may be employed.

Figure 12:
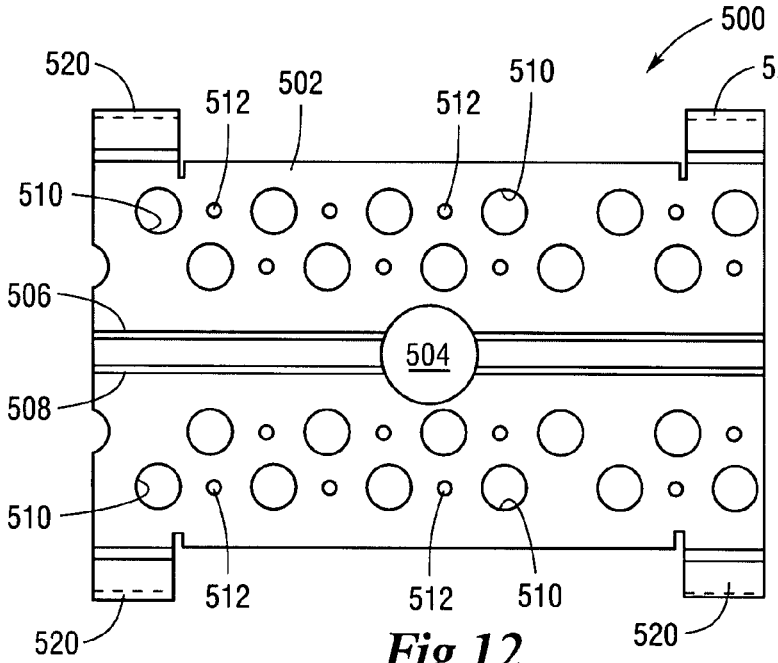
FIG. 12 is a top view of a coupling piece embodiment of the present invention.
Figure 13:
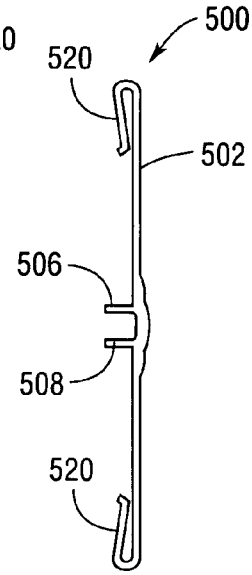
FIG. 13 is a side elevational view of the coupling piece embodiment depicted in FIG. 12.
Figure 14:
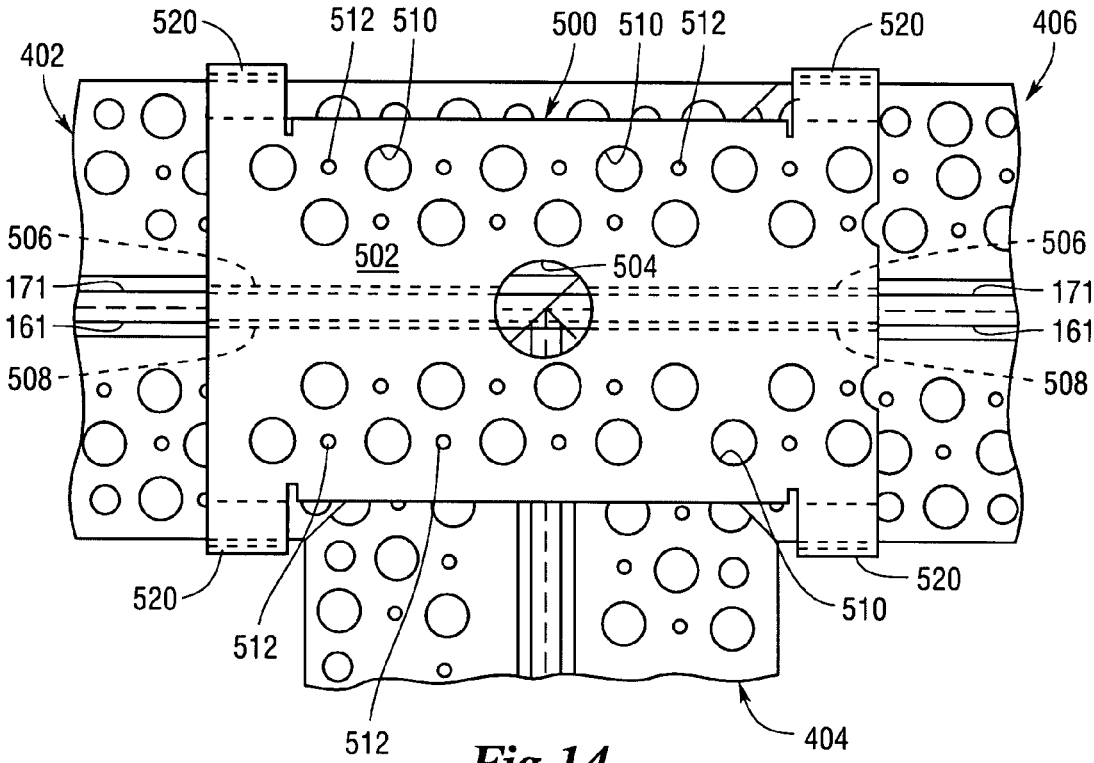
FIG. 14 is a bottom view of a coupling piece embodiment of the present invention attached to the "T"-arrangement depicted in FIGS. 10 and 11.
Figure 15:
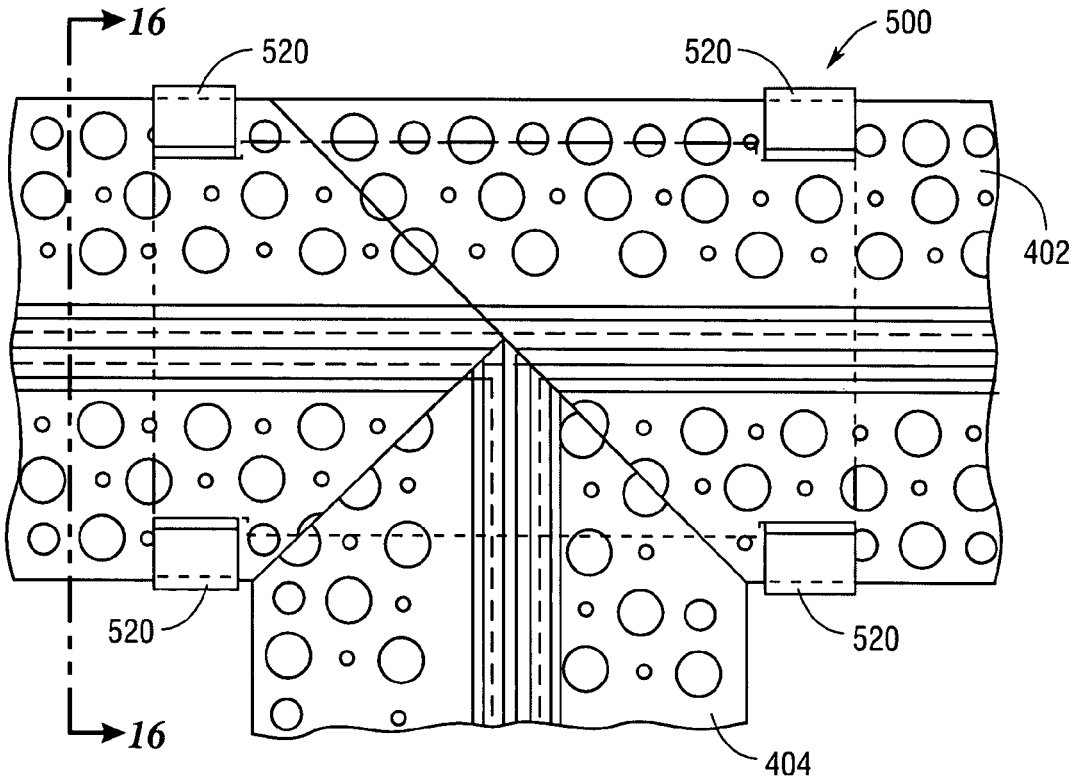
FIG. 15 is a top view of the coupling piece and "T"-arrangement of FIG. 14.
Figure 16:
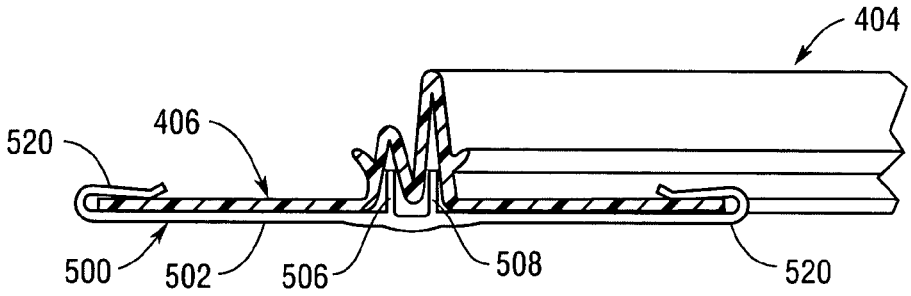
FIG. 16 is a partial cross-sectional view of the coupling piece and "T"-arrangement depicted in FIG. 15 taken along line XV-XV in FIG. 15.

In one embodiment, the coupling piece 500 may be configured as shown in FIGS. 12 and 13. As can be seen in those Figures, the coupling piece 500 includes a base portion 502 that is preferably sized to span the joints formed by the pieces 402, 404, 406 of the "T" arrangement 400. See FIG. 14. A hole 504 is centrally located in the base portion 502 to assist the installer in centrally positioning the coupling piece 500 during installation. Protruding laterally outward from diametrically opposite portions of hole 504 are pairs of spaced legs 506, 508.

In addition, a collection of holes 510 are provided through the base portion 502 as shown in FIG. 12 to facilitate retention of the plaster materials, if desired. Holes 510 may be round as shown and may be provided in various sizes. In the alternative, holes 510 may be provided in other shapes, sizes and arrangements without departing from the spirit and scope of the present invention. In addition, a series of fastener holes 512 are provided through the first base portion 502 to enable fasteners 514 for fastening the base portion 502 to an underlying structure 600 as will be discussed in further detail below.

The coupling piece 500 further has four clip arms 520 formed on the base portion to enable the coupling piece 500 to be clipped onto the "T" arrangement in the manner shown in FIGS. 9 and 14-16. When clipped in position, the legs 506 on each side of the central hole 504 in the base portion 502 are received in the space or inverted V-shaped trough 171 formed between the second screed wall 140 and the second intermediate web 170 and the legs 508 on each side of the central hole 504 are received in the space or inverted V-shaped trough 161 between the first screed wall 130 and the first intermediate web 160. Such arrangement provides significant support to the "T" arrangement where the pieces 402, 404, 406 come together. In one embodiment, the coupling piece is fabricated from vinyl or the types of Polyvinylchloride described above utilizing conventional extrusion equipment and techniques. However, the coupling piece 500 may be fabricated from a variety of other suitable polymer materials, metal material, etc. without departing from the spirit and scope of the present invention.

The formation and installation of one embodiment of a "T" arrangement 400 of the present invention will now be described. One end of each of the pieces 402, 404, 406 is mitered in a desired manner to enable those ends to be abutted together as illustrated in FIGS. 10 and 11. The reader will appreciate that the other ends of the pieces 402, 404, 406 may be similarly mitered to enable those ends to be adjoined in a similar manner to other pieces of control joint 100. The ends of pieces 402, 404, 406 may be cut utilizing conventional cutting equipment commonly employed to cut banding beads and the like. After the ends of the pieces 402, 404, 406 are cut at desired angles, they are abutted together and they may be retained in that position by applying segments of commercially available tape 420. See FIG. 11. In addition, adhesive medium, sealant or caulking 422 may be applied as shown in FIG. 10.

Figure 8:
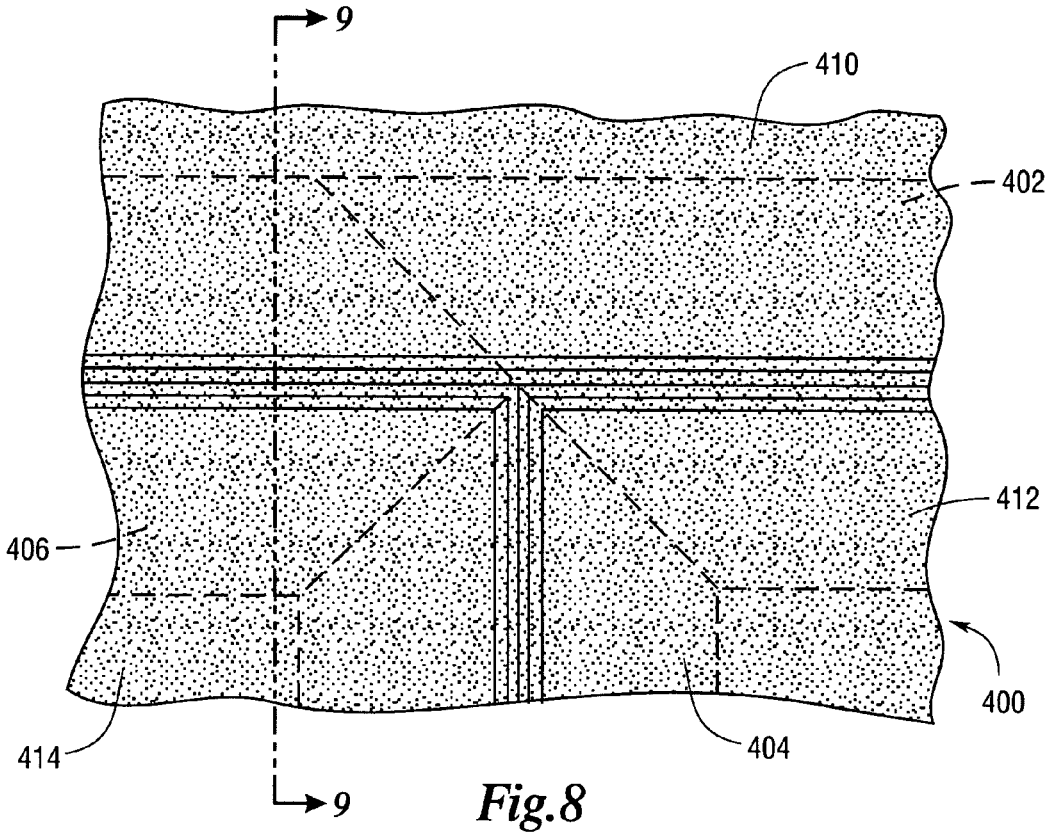
FIG. 8 is a plan view of a portion of a "T"-arrangement of the present invention formed from embodiments of the control joint of the present invention and having different thicknesses of plaster applied thereto.
Figure 9:
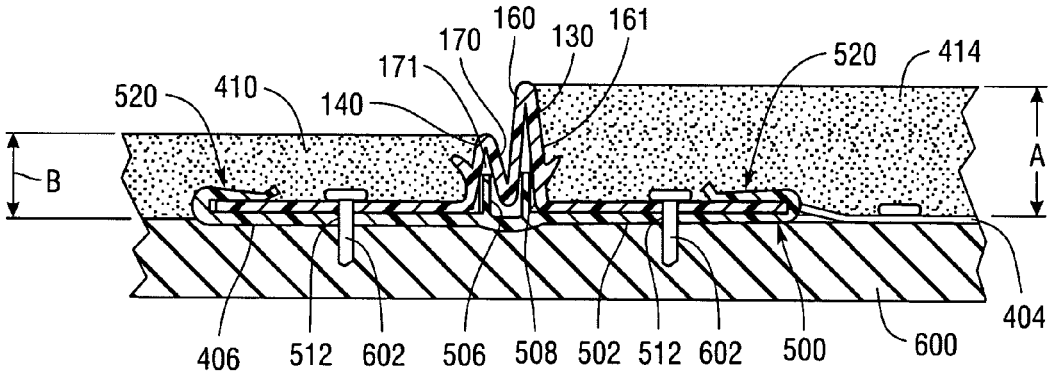
FIG. 9 is a cross-sectional view of the "T" arrangement of FIG. 8 taken along line IX-IX in FIG. 8.

In one embodiment, one or more of the coupling pieces 500 are attached to the underlying structure 600 by fasteners 602 that extend through the fastener holes 512 in the base portion 502. As was discussed above, the underlying structure 600 may be fabricated from a variety of different materials, such as wood, steel, brick, concrete, wallboard, etc. Appropriate fasteners 602 such as nails, screws, concrete fasteners, etc. may be used depending upon the composition of the underlying structure 600. After the coupling piece or pieces 500 are attached to the underlying structure 600, the "T"-arrangement 400 may be snapped into the coupling pieces 500 and temporarily retained in position. Such arrangement may also enable the installer to slide the "T"-arrangement 400 in the coupling pieces 500 to locate the "T"-arrangement 400 in the desired position. After the "T"-arrangement 400 is located in the desired position, the pieces 402, 404, 406 (and other pieces of control joint 100 attached thereto) may be attached to the underlying structure 600 by conventional fasteners 602 in the manner described above. After the pieces 402, 404, 406 (and other pieces of control joint 100 needed to complete the desired design) have been attached to the underlying structure 600, the plaster materials 410, 412, 414 may be applied thereto as shown in FIG. 8. The thicknesses of the applied plaster materials 410, 412, 414 may be governed by the heights of the first and second screed walls (distances "A" and "B" as described above). As in the other embodiments, the distances "A" and "B" are unequal.

As can be appreciated from the foregoing description, the unique and novel control joint embodiments of the present invention solve many problems encountered when applying different thicknesses of plaster along a building wall or walls. Such invention provides an effective way of establishing the desired thickness of materials to be applied while forming screed walls along a point wherein the different thicknesses of material are adjacent to each other. Various embodiments of the subject invention also enable the first screed wall to move independent from the second screed wall to accommodate different material movements due to, for example, differences in thermal expansion and contraction. While various embodiments of the control joint of the present invention are particularly well suited for use in connection with adjoining walls of dissimilar construction, various embodiments of the present invention can also be effectively used along joints between walls of like construction. Thus, the scope of protection afforded to various embodiments of the present invention should not solely be limited to applications involving use with walls, structures, etc. that are of dissimilar construction.

The invention which is intended to be protected is not to be construed as limited to the particular embodiments disclosed. The embodiments are therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

What is claimed is:

1. A flexible control joint, comprising:

a first base portion;

a first screed wall having a first proximal end protruding from said first base portion and having a first distal end located a first distance away from said first base portion, said first screed wall configured to form a first end wall for a first amount of plaster having a first thickness that is substantially equal to said first distance;

a second base portion substantially co-planar with said first base portion;

a second screed wall having a second proximal end protruding from said second base portion and having a second distal end located a second distance away from said second base portion and wherein a predetermined difference exists between a magnitude of said second distance and another magnitude of said first distance, said second screed wall configured to form a second end wall for a second amount of plaster having a second thickness that is substantially equal to said second distance; and a flexible attachment assembly attached between said first screed wall and said second screed wall such that said first and second screed walls are in spaced relationship to each other and wherein said flexible attachment assembly facilitates flexible movement between said first and second screed walls; and a first plaster-retainer protruding from said first screed wall; and a second plaster-retainer protruding from said second screed wall;

said first plaster-retainer protrudes from said first screed wall at an acute angle away from said first screed wall and wherein said second plaster retainer protrudes from said second screed wall at an acute angle away from said second screed wall.

2. The control joint of claim 1 wherein said flexible attachment assembly member has an accordion-like shape.

3. The control joint of claim 2 wherein said flexible attachment assembly comprises:

a first intermediate web attached to said first distal end of said first screed wall, said first intermediate web having a first intermediate web end intermediate said first proximal end of said first screed wall and said second proximal end of said second screed wall and being spaced from said first proximal end and said second proximal end; and a second intermediate web attached to said first intermediate web end and said second distal end of said second screed wall and extending therebetween.

4. The control joint of claim 1 further comprising:

at least one first hole in said first base portion; and at least one second hole in said second base portion.

5. The control joint of claim 1 wherein said control joint is fabricated from vinyl material.

6. A flexible control joint, comprising:

a first base portion;

a first screed wall having a first proximal end protruding from said first base portion and having a first distal end located a first distance away from said first base portion, said first screed wall configured to form a first end wall for a first amount of plaster having a first thickness that is substantially equal to said first distance;

a second base portion;

a second screed wall having a second proximal end protruding from said second base portion and having a second distal end located a second distance away from said second base portion and wherein a predetermine difference exists between a magnitude of said second distance and another magnitude of said first distance, said second screed wall configured to form a second end wall for a second amount of plaster having a second thickness that is substantially equal to said second distance;

a first intermediate web attached to said first distal end of said first screed wall, said first intermediate web having a first intermediate web end intermediate said first proximal end of said first screed wall and said second proximal end of said second screed wall and being spaced from said first proximal end and said second proximal end;

a second intermediate web attached to said first intermediate web end and said second distal end of said second screed wall and extending therebetween to facilitate flexible movement between said first and second screed walls;

a first plaster-retainer protruding from said first screed wall; and a second plaster-retainer protruding from said second screed wall.

7. The control joint of claim 6 further comprising:

at least one first hole in said first base portion; and at least one second hole in said second base portion.

8. The control joint of claim 6 wherein said control joint is fabricated from vinyl material.

* * * * *